United States Patent [19]

Kawajiri

[11] Patent Number: 4,551,360

[45] Date of Patent: Nov. 5, 1985

[54] METHOD OF OFFSET PRINTING ON POLYPROPYLENE RESIN CASES FOR VIDEO TAPE CASSETTES

[75] Inventor: Masayuki Kawajiri, Tokyo, Japan

[73] Assignee: Dai Nippon Insatsu Kabushiki Kaisha, Tokyo, Japan

[21] Appl. No.: 670,900

[22] Filed: Nov. 13, 1984

[30] Foreign Application Priority Data

Nov. 10, 1983 [JP] Japan ..... 58-211372

[51] Int. Cl.[4] ..... B05D 1/36; B05D 5/04; B05D 7/04

[52] U.S. Cl. ..... 427/160; 427/261

[58] Field of Search ..... 427/160, 261

[56] References Cited

U.S. PATENT DOCUMENTS 4,478,889 10/1984 Maruhashi et al. ..... 427/160 X

*Primary Examiner*—James R. Hoffman

*Attorney, Agent, or Firm*—Parkhurst & Oliff

[57] ABSTRACT

Offset printing on a polypropylene resin case for a video tape cassette is readily and effectively accomplished by: first applying an anchor coat, containing a polyol, a polyester and a vinyl chloride resin as principal components and isocyanate as a curing agent, onto the surface to be thus printed of a polypropylene sheet from which a blank sheet is to be die cut and assembled into said case; subjecting the anchor coat to a precuring treatment; and then offset printing on the anchor coat surface with the use of an offset printing ink of ultraviolet ray-curing tape before the anchor coat becomes fully cured.

7 Claims, 3 Drawing Figures

METHOD OF OFFSET PRINTING ON POLYPROPYLENE RESIN CASES FOR VIDEO TAPE CASSETTES

BACKGROUND OF THE INVENTION

This invention relates to a method of offset printing on a polypropylene resin case for a video tape cassette.

Polypropylene resin sheets are being used in great quantities for paper holders, cases for video tape cassettes, and various other articles. Particularly in recent years, the use of this sheet material for cases of video tape cassettes has been increasing rapidly. Printing must be carried out on cases of video tape cassettes, but printing on the surface of polypropylene resin is extremely difficult. In the present state of the art, printing on surfaces of polypropylene resin is limited to silk screen printing with the use of epoxy resin ink.

Unfortunately, silk screen printing is accompanied by a number of problems such as low productivity, high cost, low printing accuracy, limited patterns, and the necessity of repeating printing for every color in the case of multicolor printing since only single-color printing can be carried out by this printing technique.

Accordingly, if an effective method of printing on polypropylene resin surfaces by a generally known offset printing technique could be devised and developed, the above enumerated problems would be solved, and the method would be advantageous in numerous aspects.

SUMMARY OF THE INVENTION

In view of the above described circumstances, it is an object of this invention to provide a method which makes possible effective offset printing on cases of video tape cassettes which cases are fabricated from polypropylene resin sheet.

According to this invention, briefly summarized, an anchor coat is first applied onto a surface to be printed of a sheet of polypropylene resin to be folded into a case for a video tape cassette, and offset printing is carried out on the anchor coat surface by using an offset printing ink of ultraviolet ray-curing type.

The nature, utility, and further features of this invention will become more clearly apparent from the following detailed description when read in conjunction with the accompanying drawings briefly described below.

DETAILED DESCRIPTION OF THE INVENTION

Figure 1:
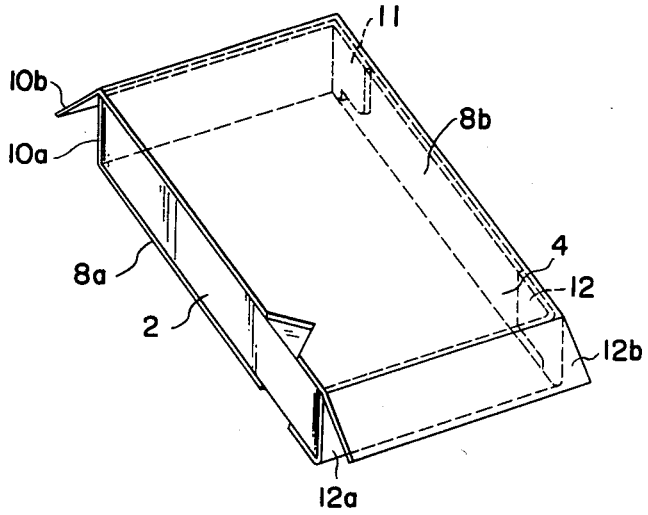
FIG. 1 is a perspective view, with some parts which would otherwise be invisible from the outside shown by dotted phantom lines, of a video tape cassette accommodated within an almost completely assembled case.
Figure 2:
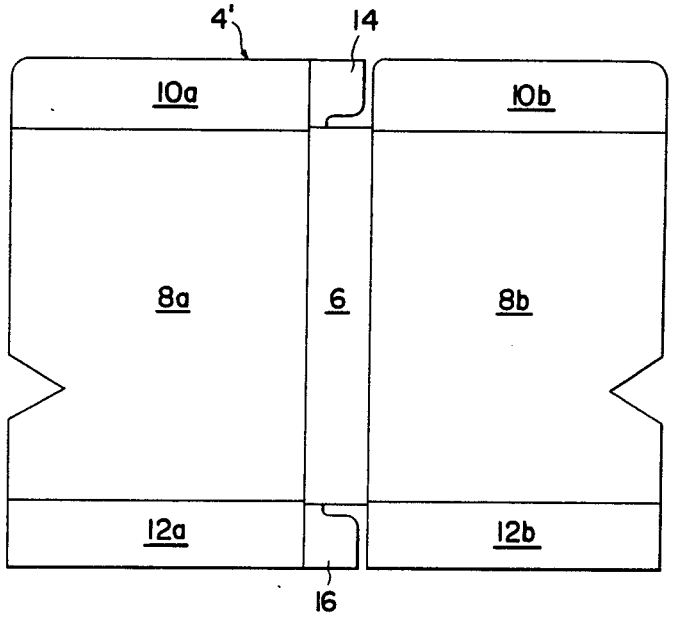
FIG. 2 is an expansion or development plan of a blank sheet to be assembled by folding and heat sealing to form the cassette case shown in FIG. 1.

FIG. 1 shows a video tape cassette 2 accommodated within a box-shaped case 4. This case 4 is formed by folding a blank sheet 4' shown as an expansion or development plan in FIG. 2 and comprising a back panel 6, first and second main panels 8*a* and 8*b*, side panels 10*a*, 10*b*, 12*a*, and 12*b*, and side flaps 14 and 16. Crease or fold lines are formed between contiguously adjoining panels and between panels and adjacent flaps.

The case 4 is assembled by folding the side panels 10*a* and 12*a* inward at right angles relative to the main panel 8*a* and then the side flaps 14 and 16, folding the main panel 8*b* toward the other main panel 8*a* until they are parallel along the fold lines between them and the back panel 6, folding inward the remaining side panels 10*b* and 12*b* overlappingly against the outer faces of the side panels 10*a* and 12*a*, respectively, and heat sealing these overlapping side panels.

Figure 3:
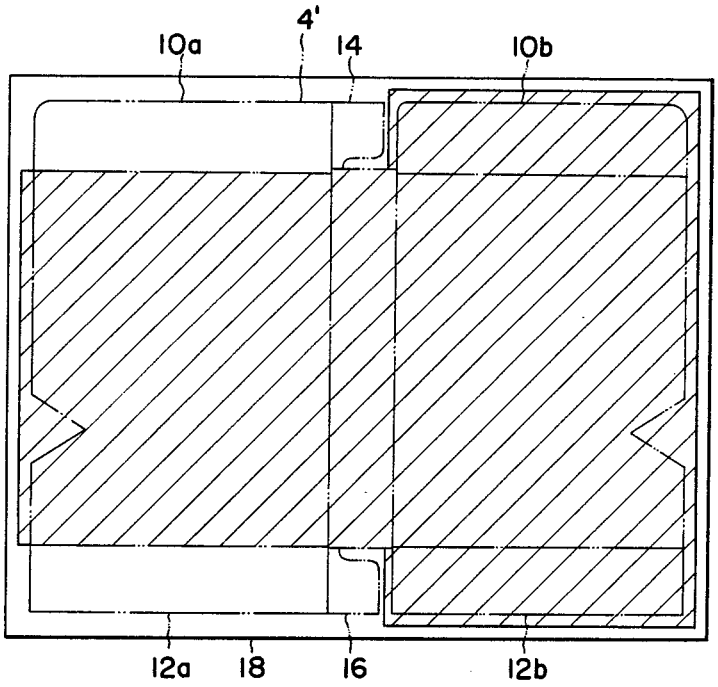
FIG. 3 is a plan view showing the relationship between a sheet stock material and the blank sheet shown in FIG. 2 and further showing by hatched lines that portion of the sheet stock material to be coated with an anchor coat.

The blank sheet 4' is formed by die cutting or punching from a polypropylene resin sheet (stock material) 18 as shown in FIG. 3. The fold lines are then formed.

Markings and/or inscriptions are printed on the sheet 18 according to this invention as described below prior to the die cutting or punching.

First, a white or a colorless and transparent anchor coating layer or coat is applied on the sheet 18 throughout the region indicated by cross-hatching in FIG. 3. Since the front surface (near side) of the sheet 18 in FIG. 3 is to become the inner surface of the case 4, the anchor coat is actually applied on the back surface over the cross-hatched region. The outer surfaces of the side panels 10*a* and 12*a* to be on the inner side at the time of folding assembly are not coated with the anchor coat because they are to be heat sealed with the side panels 10*b* and 12*b*, respectively, to be superimposed thereover on their outer sides.

For the sheet 18, a white sheet of 0.75 mm thickness is ordinarily used. A color other than white is not desirable since there is a limit to the opacifying property of the ink used in the offset printing to be finally carried out as described hereinafter.

The anchor coat can be applied by screen printing or by gravure printing. The ink for the anchor coat in the case of screen printing preferably contains a polyol, a vinyl chloride resin, and a polyester as principal components and contains isocyanate as a curing agent. One example of a recommendable screen printing ink composition of this character is that manufactured by Seiko Advance Kabushiki Kaisha, Japan. Screen printing is most preferred because it imparts a smooth surface to the anchor coat.

On the other hand, the ink for the anchor coat in the case of gravure printing preferably contains a polyolefinic resin as a binder. One example of a recommendable ink of this character for use as an ink for the anchor coat on polypropylene is that manufactured by Morohoshi Ink Kabushiki Kaisha, Japan.

By applying an anchor coat in the above described manner, the adhesion of an offset-printing ink relative to a polypropylene resin sheet, which otherwise would be inadequate, is improved.

As stated hereinabove, the ink for the anchor coat contains principal components and a curing agent, which react upon being mixed, and this reaction proceeds gradually. For example, the above mentioned polyol, polyester and isocyanate gradually undergo a crosslinking reaction and form a three-dimensional network thereby becoming hard. In order to promote this hardening or curing, the anchor coat, immediately after it has been applied, is heated, for example, at 65° C. for a period of the order of 15 minutes thereby to carry out precuring. By this step, the curing is completed for the most part, but the remaining curing progresses over approximately two weeks.

After the precuring, the surface of the anchor coat is offset printed with the use of an offset ink of a type which is hardenable or curable by ultraviolet rays. For this offset ink, an ultraviolet ray-curing type ink for video tape recorders (VTR) manufactured by Toka Shikiso Kabushiki Kaisha, Japan, or Morohoshi Ink Kabushiki Kaisha, Japan, is used. These inks are of the acrylic type and other types and, in all cases, are fast-drying and have excellent abrasion wear resistance and scratch resistance.

The offset printing can be carried out in the same manner as the conventional printing on plastic sheets. However, since the sheet in the instant case is thick, it is necessary to carry out thorough adjustment of the printing press and to take some antistatic measure. In order to improve the abrasion resistance even more, it is also possible to coat the printed surface with over-print varnish. For this varnish, a transparent acrylic ink of the ultraviolet ray curing type is suitable.

The offset printing on the anchor coat must be carried out with the anchor coat after precuring still in the state of undergoing curing in which the crosslinking reaction is still occurring. For example, in the case of the aforementioned anchor coat comprising a polyol, a polyester, a vinyl chloride and isocyanate, since its curing takes approximately two weeks to completion, the offset printing can be advantageously carried out during this period. By so doing, procedures such as transportation and preparation for printing can be carried out with ample leeway in time in the period from the application of the anchor coat on the polypropylene resin sheet to the offset printing step.

Direct offset printing immediately after anchor coat application without precuring is difficult. The reason for this is that the anchor coat is still in an adhesive or tacky state. On the other hand, offset printing after the anchor coat has been fully cured is also undesirable. It has been found that, when the offset printing is carried out before the anchor coat has thoroughly cured, the offset ink adheres strongly to the anchor coat and a good printing can be obtained.

In order to indicate more fully the nature and utility of this invention, the following two specific examples of practice thereof are set forth, it being understood that these examples are presented as illustrative only and are not intended to limit the scope of the invention.

EXAMPLE 1

An anchor coat was applied by silk printing on the surface of a white polypropylene resin sheet of a thickness of 0.75 mm (front surface: fine matte, back surface: embossed, manufactured by Achilles Kabushiki Kaisha, Japan) except for parts thereof to become bonded parts. The anchor coat material was SD Matte Medium (brand name, manufactured by Seiko Advance Kabushiki Kaisha, Japan), in which the compositional ratio of the principal component to a curing agent was 10 parts to 1 part. To this 11 parts of the mixture, 8 parts of an aromatic hydrocarbon solvent was added. For the principal component, a mixture of a polyester, a vinyl chloride resin, and a polyol (in which the polyol was the predominant ingredient) was used. Isocyanate was used for the curing agent.

Since a minimum quantity of the anchor coat composition is sufficient for application, a screen mesh of 300 lines/inch or higher was used. The precuring of the anchor coat was carried out at 65° C. for 15 minutes, i.e., to an extent which will not give rise to blocking of sheets when the sheets are stacked.

Immediately after the anchor coating, offset printing with an offset ink of ultraviolet ray-curing type was carried out by means of an offset multicolor printing press for paper boards. For this ink, UV ink for VTR use (manufactured by Toka Shikiso Kabushiki Kaisha, Japan, or by Morohoshi Ink Kabushiki Kaisha, Japan), in which the principal component is an acrylate resin, was used. The printing surface was irradiated with ultraviolet rays at 160 W/cm by three or more lamps. After drying of the UV ink, the anchor coat material was fully cured by leaving the stock material to stand or by heating the same.

After the offset printing has been carried out on the blank sheet, the sheet was die cut, and folding lines were formed under heat. After assembly of a case from the sheet, heat sealing was carried out, whereupon the desired product was obtained. By this method, surface properties such as scratch resistance and alcohol resistance, comparable to those produced by conventional silk screen printing, were obtained.

EXAMPLE 2

An anchor coat was applied by gravure printing on a sheet material equivalent to that used in Example 1. For the anchor coat material a primer (manufactured by Morohoshi Ink Kabushiki Kaisha, Japan) for polypropylene containing 10 parts of a modified polypropylenic stock solution and 2 parts of toluene as a solvent was used. The deepness of the gravure printing plate was 35 microns.

After the anchor coating, offset printing was carried out in the same manner as in Example 1 with the use of an offset printing ink of ultraviolet ray-curing type. For this ink, an acrylic UV ink for VTR use (manufactured by Morohoshi Ink Kabushiki Kaisha, Japan) was used. Finally, a transparent acrylic ink of ultraviolet ray-curing type was applied as an overprint varnish. After the printing, the steps of die-cutting, formation of folding lines under heat, assembling, and heat sealing were carried out similarly as in Example 1 to obtain the desired product.

In comparison with the conventional silk-screen printing, the offset printing method according to this invention using an offset printing ink of ultraviolet ray-curing type as described hereinabove is inferior on the point of ink thickness, that is, the apparent color density, but is substantially comparable to the conventional silk-screen printing in surface strength. On the point of productivity, the method of this invention is superior, particularly because of its rapid drying characteristic, and is advantageous in that it makes possible printing of tonal patterns. Furthermore, the method of this invention is an excellent method of printing on polypropylene cases for video tape cassettes for quantity production and diversification of patterns.

What is claimed is:

1. A method of offset printing on a polypropylene resin case for a video tape cassette, which comprises the steps of first applying an anchor coat onto the surface to be thus printed of a polypropylene sheet to be folded into said case, and then carrying out offset printing on the anchor coat surface by using an offset printing ink of ultraviolet ray-curing type.

2. A method of offset printing on a polypropylene resin case for a video tape cassette according to claim 1 in which, the anchor coat, after it has been applied, is subjected to a precuring treatment, and the offset printing is carried out before the anchor coat becomes fully cured.

3. A method of offset printing on a polypropylene resin case for a video tape cassette according to claim 2 in which the anchor coat contains a polyol, a polyester and a vinyl chloride resin as principal components and isocyanate as a curing agent.

4. A method of offset printing on a polypropylene resin case for a video tape cassette according to claim 3 in which the precuring treatment is carried out for 15 minutes at a temperature of 65° C.

5. A method of offset printing on a polypropylene resin case for a video tape cassette according to claim 1 in which the anchor coat is applied on said sheet to be folded into said case over the surface thereof exclusive of the parts thereof to be heat sealed at the time of assembly of the case.

6. A method of offset printing on a polypropylene resin case for a video tape cassette according to claim 1 in which the anchor coat is applied by screen printing.

7. A method of offset printing on a polypropylene resin case for a video tape cassette according to claim 1 in which the anchor coat is applied by gravure printing.

* * * * *